US005975429A

United States Patent [19]

Jezek

[11] Patent Number: 5,975,429

[45] Date of Patent: Nov. 2, 1999

[54] HIGH PRESSURE FLUID APPARATUS FOR BLAST CLEANING

[75] Inventor: Paul D. Jezek, Houston, Tex.

[73] Assignee: J. Edward Stachowiak

[21] Appl. No.: 08/997,230

[22] Filed: Dec. 23, 1997

[51] Int. Cl.[6] ..... B05B 9/00

[52] U.S. Cl. ..... 239/124; 239/445; 239/526; 137/882

[58] Field of Search ..... 239/124, 443, 239/445, 447, 525, 526, 583, 586, DIG. 22; 137/882

[56] References Cited

U.S. PATENT DOCUMENTS

| | | | |
|---|---|---|---|
| 3,672,575 | 6/1972 | Hinrichs | 239/445 |
| 3,765,607 | 10/1973 | Pacht | 239/124 |
| 3,802,628 | 4/1974 | Goss et al. | 239/445 X |
| 3,987,963 | 10/1976 | Pacht | 239/124 |
| 4,593,858 | 6/1986 | Pacht . | |
| 4,602,740 | 7/1986 | Stachowiak . | |
| 5,165,451 | 11/1992 | Goldsmith | 239/124 X |
| 5,224,686 | 7/1993 | Pacht . | |
| 5,253,808 | 10/1993 | Pacht | 239/124 |
| 5,419,365 | 5/1995 | Jezek . | |
| 5,423,348 | 6/1995 | Jezek . | |
| 5,535,949 | 7/1996 | Boisture | 239/124 |
| 5,636,789 | 6/1997 | Shook | 239/124 |

*Primary Examiner*—Kevin P. Shaver
*Assistant Examiner*—Steven J. Ganey
*Attorney, Agent, or Firm*—Browning Bushman

[57] ABSTRACT

A high pressure fluid blast gun (10) has a valve assembly (12) and a handle assembly (14) removably connected to each other. Valve assembly (12) has a valve body (16) including a valve chamber (18) having a cartridge therein including a valve sleeve (30), and a slidable valve member (42). A plug (44) retains the cartridge in valve chamber (18). The handle assembly (14) has a mounting plate (70) and a handle grip portion (75) extending therefrom. A guard (76) extends from the handle grip portion (75) to mounting plate (70) for enclosing the trigger (78). A pair of dump passages (62) in valve body (16) communicate with dump port (66) in face (28) of valve body (12). A dump passage (94) in opposed face (71) of handle assembly (14) is in communication with dump port (66) and extends to atmosphere for relief of the high pressure water when trigger (78) is manually released thereby to provide a low pressure flow of water from high pressure supply conduit (24). The embodiment of FIGS. 4 and 5 includes a main gun body (11A) having a cylindrical opening (17A) receiving a cylindrical valve body (16A).

16 Claims, 3 Drawing Sheets

FIG. 4
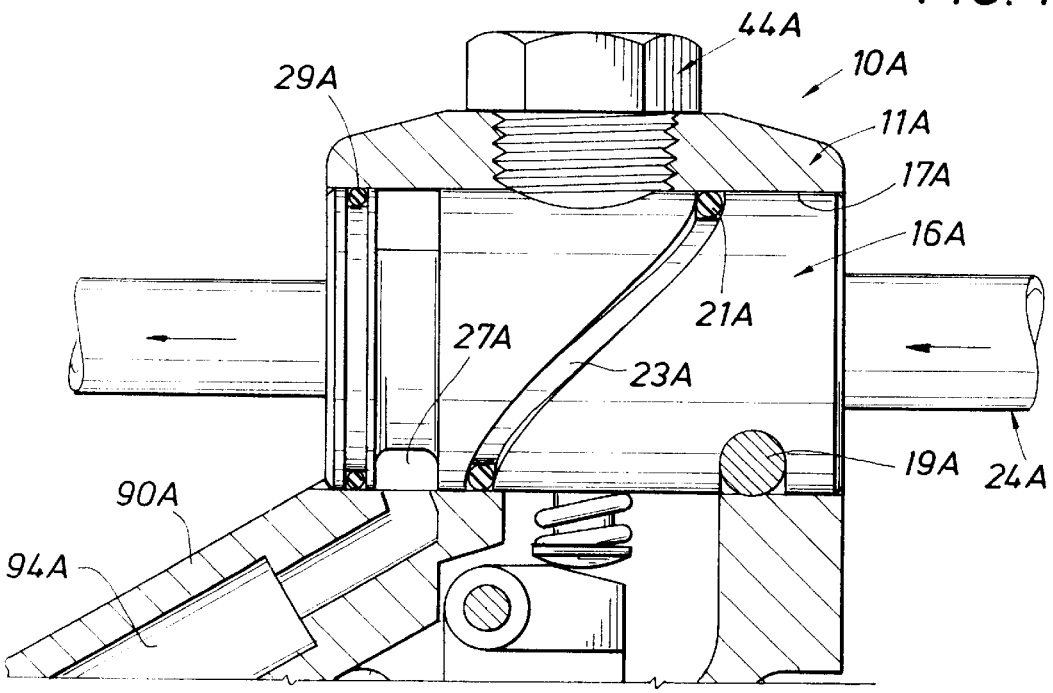
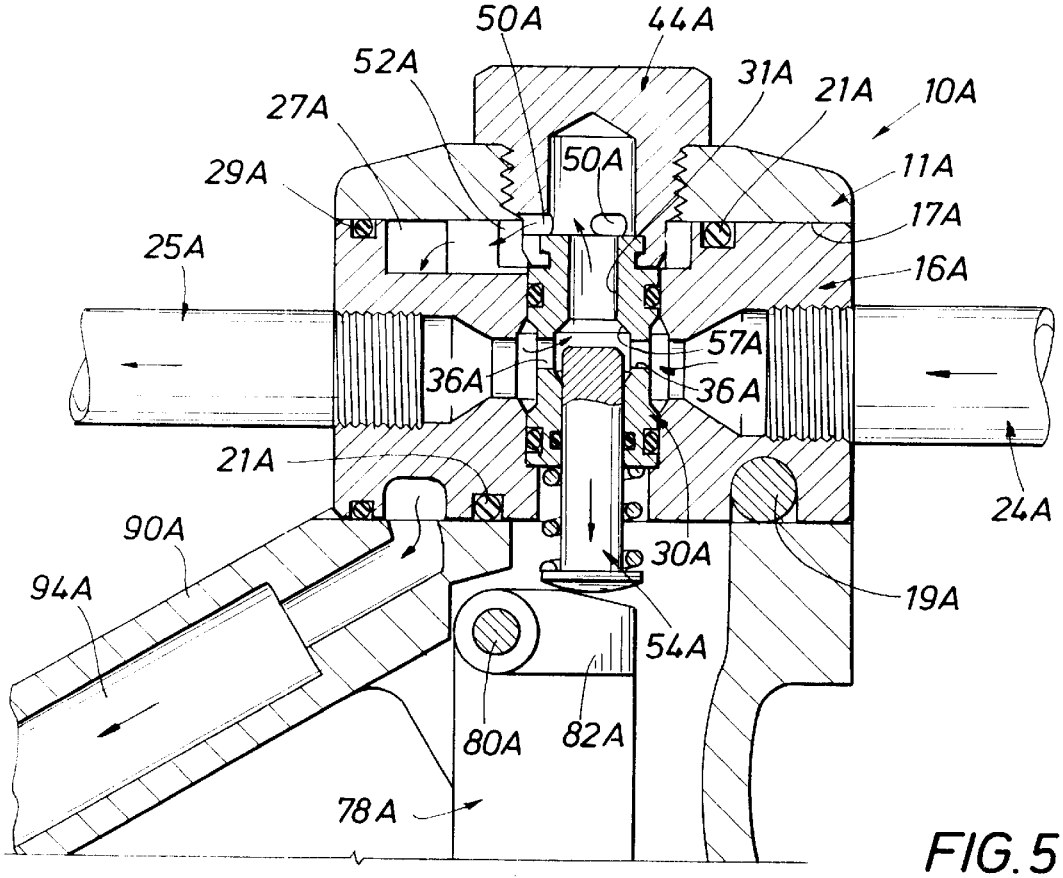
FIG. 5

HIGH PRESSURE FLUID APPARATUS FOR BLAST CLEANING

FIELD OF THE INVENTION

This invention relates to a high pressure fluid apparatus for blast cleaning, and more particularly to such a high pressure fluid apparatus including a dump passage to atmosphere for relieving the high pressure upon release of the manual trigger.

BACKGROUND OF THE INVENTION

Heretofore, such as shown in U.S. Pat. No. 4,602,740 dated Jul. 29, 1986, high pressure water blast guns have been provided with a dump conduit for discharging water at low pressure from a dump conduit or nozzle when the high pressure water stream to the high pressure discharge nozzle is interrupted during use upon release of the manual trigger. The dump nozzle or conduit in the '740 patent extends from the valve body in a generally parallel relation to the superjacent high pressure discharge conduit or pipe. The handle is removably connected to the valve body beneath the dump passage and conduit. Thus, a separate dump conduit is connected to the valve body for relief of the high pressure when the valve member communicating with the high pressure supply conduit is opened to provide direct communication between the high pressure water supply conduit and the dump conduit for relieving the high pressure to the discharge nozzle.

U.S. Pat. No. 5,423,348 dated Jun. 13, 1995 shows a high pressure water shut-in gun in which fluid flow is stopped completely upon manual release of the trigger or actuator for the valve mechanism. The '348 patent does not have a dump or high pressure relief outlet for relieving the high pressure water upon release of a manual trigger.

SUMMARY OF THE INVENTION

The present invention is directed particularly to a high pressure water blast gun having a dump conduit or passage to atmosphere for relieving the high pressure when the high pressure stream to the high pressure discharge nozzle is interrupted during use. The water blast gun has a handle assembly removably connected to the valve body assembly. The handle assembly includes a handle gripping portion and a guard extending from the handle gripping portion about a manually operated trigger to enclose the trigger. The guard is connected to a mounting plate or mounting flange of the handle assembly which is removably connected to a lower planar mounting surface on the valve assembly. A dump passage or conduit to atmosphere extends through the mounting flange and a guard portion adjacent the mounting flange for relief of the high pressure water when the high pressure stream is interrupted during use by release of the manual trigger by the operator. A pair of dump ports or passages in the valve assembly communicate with a primary dump port in the planar mounting face of the valve assembly which communicates with the dump passage in the handle assembly for relief of the high pressure fluid. The guard portion adjacent the mounting flange of the handle assembly in which the dump passage is located is of an enlarged cross section to provide a dump passage having a diameter of about one-inch (½) inch sufficient for relief of the high pressure water so that a low pressure stream of water flows from the dump passage to atmosphere. Each of the pair of dump ports in the valve assembly or valve body is preferably about five sixteenths (5/16) inch in diameter.

The present invention provides a compact water blast gun in which the dump port outlet is located entirely within the handle assembly adjacent the valve body and is effective to provide a low pressure drain of fluid from the high pressure conduit upon release of a manual trigger. Thus, no separate dump conduits extend outwardly from the valve body.

Other features and advantages of the invention will be apparent from the following specification and drawings.

BRIEF DESCRIPTION OF THE DRAWINGS

FIG. 4 is an enlarged sectional view, partly in elevation, of another embodiment of this invention in which a cylindrical body portion is inserted within a cylindrical opening in the main body of the water blast gun; and FIG. 5 is an enlarged cross sectional view of the water blast gun embodiment shown in FIG. 4 showing the cylindrical body portion in longitudinal cross section with the trigger released for providing a low pressure drain of fluid from the high pressure conduit.

DESCRIPTION OF THE INVENTION

Figure 1:
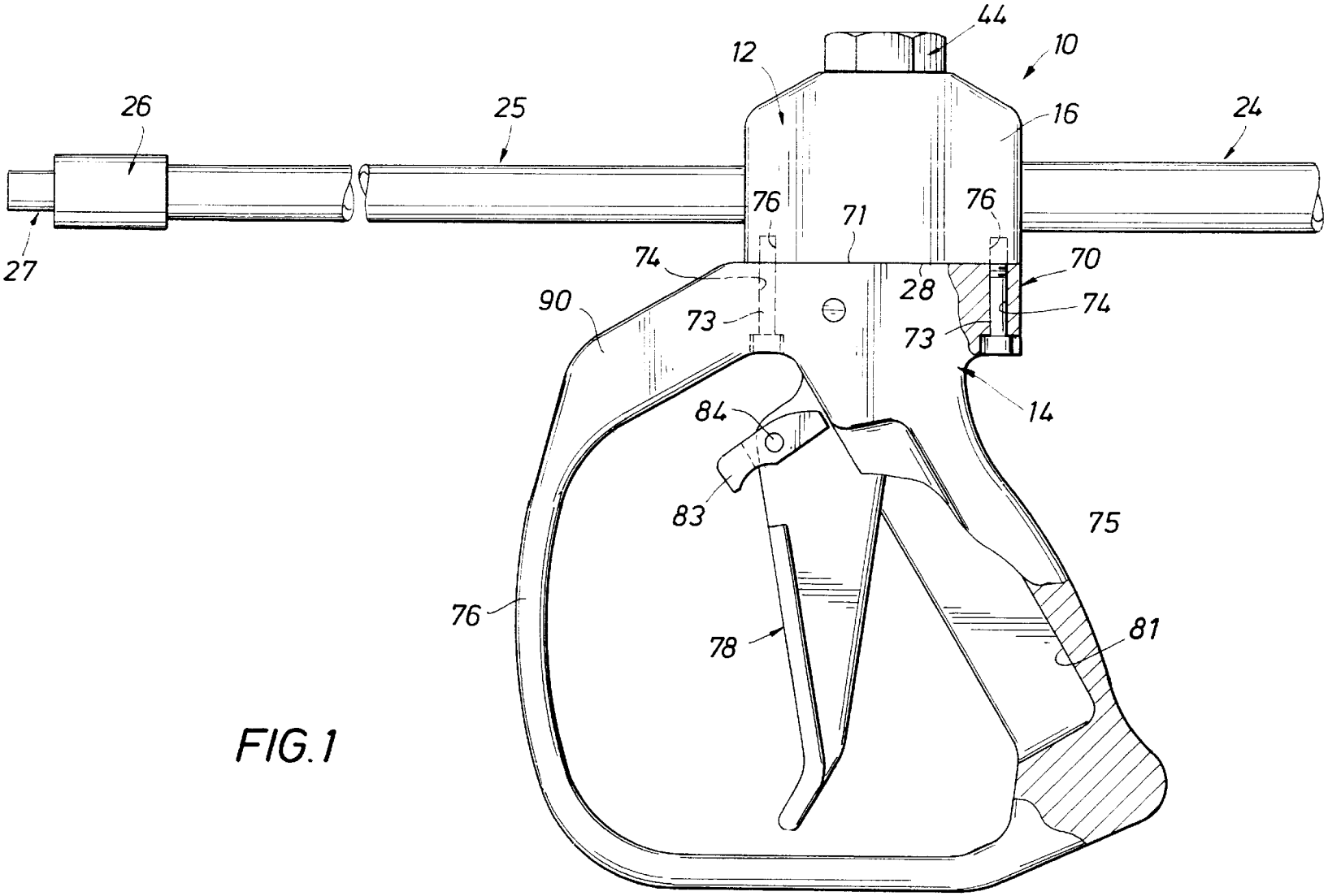
FIG. 1 is a side elevational view, with certain parts broken away, showing the water blast gun of the present invention connected to a high pressure water source for discharge of a high pressure stream from a high pressure nozzle for cleaning surfaces.
Figure 2:
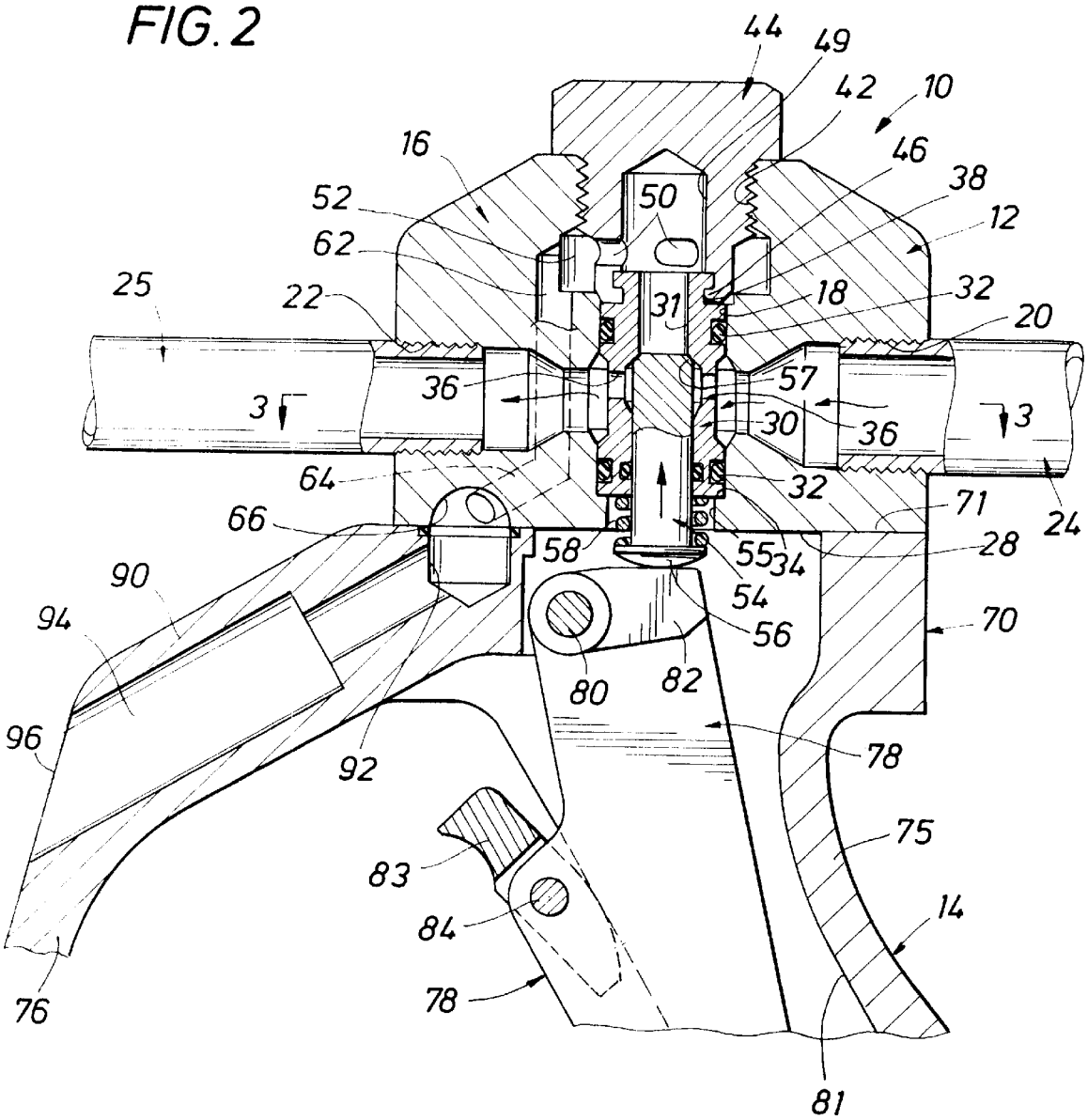
FIG. 2 is an enlarged cross-sectional view of a portion of the water blast gun shown in FIG. 1 showing the water blast gun in a position in which high pressure water is provided to the high pressure discharge nozzle for discharge with the trigger depressed by an operator.
Figure 3:
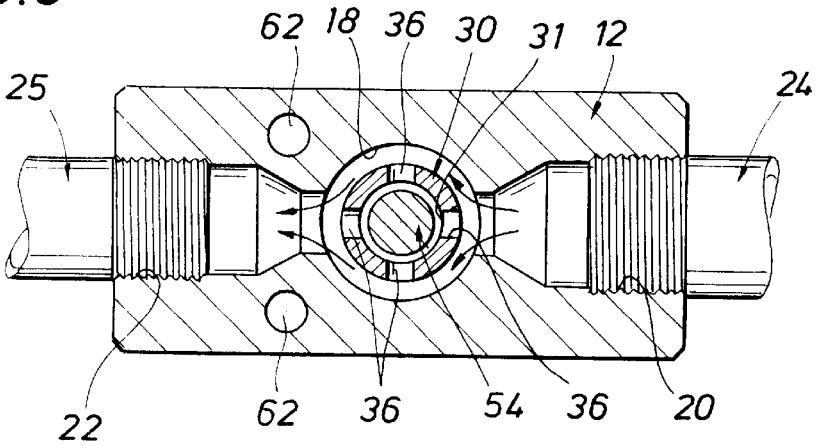
FIG. 3 is an enlarged cross-sectional view taken generally along line 3—3 of FIG. 2 and showing high pressure fluid flowing about the valve member to the high pressure discharge nozzle.

Referring now to the embodiment shown in FIGS. 1–3, a high pressure water blast gun in accordance with the present invention is shown at 10 including a valve assembly generally indicated at 12 and a handle assembly generally indicated at 14 removably connected to each other. Valve assembly 12 has a body 16 with a central bore 18 extending therethrough defining a valve chamber having open upper and lower ends. An internally threaded inlet port 20 and an opposed internally threaded outlet port 22 are in communication with valve chamber 18. A high pressure water supply conduit 24 is threaded within inlet 20 and is connected to a water source provided by a suitable high pressure pump (not shown). A high pressure water discharge conduit 25 is threaded within outlet port 22 and has a high pressure discharge nozzle 26 on an end thereof with a relatively small diameter discharge port in nozzle end portion 27 to provide a high pressure jet or stream of water for cleaning surfaces or the like.

Body 16 has a lower planar surface or face 28 and valve chamber 18 extends through lower face 28. Mounted in valve chamber 18 is an outer sleeve or guide generally indicated at 30 defining a central bore 31 and a pair of O-rings 32 extend about sleeve 30 for sealing against valve body 16. Sleeve 30 fits against an annular abutment or shoulder 34 in valve body 16. A plurality of lateral ports 36 extend through a reduced diameter portion of sleeve 30 to central bore 31 at opposed ports 20 and 22. An intermediate reduced diameter portion of sleeve 30 communicates opposed ports 20 and 22 at all times. An annular groove 38 is provided about the upper end of sleeve 30.

Center bore 18 has internal threads 42 at the upper end thereof and a plug generally indicated at 44 has external screw threads for engaging internal screw threads 42. Plug 44 has an inward extending annular rim 46 received within groove 38 for longitudinal movement of sleeve 30 with plug 44 for positioning sleeve 30 in abutting contact with shoulder 34. Plug 44 has a blind central bore 49 and a plurality of lateral ports 50 extend from bore 49 through the wall of plug 44 to an enlarged diameter bore portion in valve body 16 defining an annular fluid chamber 52 about plug 40 receiving fluid from lateral ports 50.

Mounted within central bore 31 of sleeve 30 is a slidable cylindrical valve member 54 having a lower rounded end 56 extending from the lower end 55 of bore 18. Spring 58 is biased between sleeve 30 and rounded end 56 to urge valve member 54 continuously in a downward direction. Slidable cylindrical valve member 54 engages inner shoulder 57 of sleeve 30 to block flow from high pressure conduit 24 through bore 31 of sleeve 30 to ports 50 when valve member 54 is moved upwardly against the bias of spring 58. When valve member 54 moves downwardly under the influence of spring 58, fluid flow through ports 36, bore 31 and ports 50 is provided from high pressure conduit 24. A pair of spaced parallel dump passages 62 extend downwardly from annular fluid chamber 52 and have branch passages 64 extending to a generally hemispherical dump port 66 in planar face 28 of valve body 16. Sleeve or spool 30 and valve member 54 form a so-called cartridge which may be easily inserted or removed from the upper end of bore 18 by removal of plug 44.

A handle or handle assembly 14 has an upper mounting plate 70 with a planar surface or face 71 in mating contact with face 28 of valve body 16. Mounting plate 70 has openings 74 receiving fasteners 73 which are threaded within aligned internally threaded openings 76 in valve body 16 to secure handle assembly 14 releasably to valve assembly 12. Handle assembly 14 includes a handle grip portion 75 for manual gripping and a guard 76 extends from handle grip portion 75 to mounting plate 14 for enclosing a trigger generally indicated at 78. Trigger 78 is pivotally mounted at 80 within a slot 81 in handle portion 75 and has an arm or tang 82 in contact with rounded end 56 on valve member 54 for inner upward movement of valve member 54 into seated contact with shoulder 57 to block communication between bore 31 and ports 36 upon depression of trigger 78. Upon release of trigger 78, trigger 78 is urged by spring 58 to the position of FIG. 1 in which position valve member 54 is unseated from shoulder 57 to communicate ports 36 with bore 31 and lateral ports 50 to enlarged bore portion 52 and dump passages 62 as will be explained further. A latch 83 is pivotally connected at 84 to trigger 78 and is pivoted to a latched position shown in FIG. 1 to releasably lock trigger 78 in a high pressure relief position. Latch 83 and handle 78 are shown in a high pressure supply position in FIG. 2.

Guard 76 has an enlarged cross-sectional portion 90 extending from plate 70 adjacent valve body 16. Mounting face 71 of plate 70 has a generally cylindrical dump port 92 therein in axial alignment with hemispherical port 66 in planar face 28 of valve body 16. A dump passage 94 extends from dump port 92 through mounting plate 70 and enlarged cross-sectional portion 90 of guard 76 to atmosphere at end port 96.

Dump passage 94 is of a diameter preferably about one-half (½) inch in diameter and dump passages 62 in valve body 16 are each of a diameter preferably about one-fourth (¼) inch in diameter. The high pressure discharge nozzle 26 for discharge conduit has a relatively small orifice of a cross-sectional area, such as one-eighth (⅛) inch in diameter. Thus, even though high pressure fluid will be supplied to conduit 26 after the dump passage is open, such fluid will be of a low pressure as the dump passages 62, 94 are of substantially greater area such as ten to twenty times the cross-sectional area of the high pressure discharge orifice 27 for discharge nozzle 26. Sleeve 30 along with valve member 54 and plug 44 comprise a so-called cartridge which may be easily inserted within the central bore 18 of valve body 16. While blast gun 10 has been illustrated for use with water, it is understood that blast gun 10 may be utilized with other fluids such as oil or various cleaning fluids for example. The term "blast gun" as used in this specification and claims is interpreted as including a control valve apparatus for use in a high pressure fluid blast cleaning.

Operation

To provide high pressure water to discharge nozzle 26 for a water blast operation, handle grip portion 75 and trigger 78 are manually gripped to depress trigger 78 and move valve member 54 to the seated position of FIG. 2. In this position valve member 54 blocks fluid communication between ports 36 and bore 31 and high pressure water from water supply conduit 24 is provided to high pressure discharge conduit 25 between opposed ports 20 and 22 about the reduced diameter portion of sleeve 30 as shown in FIG. 3. Seals 32 prevent leakage of high pressure fluid about sleeve 30. The discharge port or orifice in nozzle 26 is of a relatively small diameter such as about one-sixteenth (1/16) inch in diameter to provide a high pressure stream against a surface to be cleaned. When it is desired to interrupt or stop the high pressure water stream, trigger 78 is released and valve 54 moves under the influence of spring 58 to an unseated position. High pressure water from high pressure water supply conduit 24 is diverted through ports 36 and sleeve 30 out through lateral ports 50 to parallel ports 62, thence from parallel ports 62 to ports 66, 92 and dump passage 94 for a low pressure flow from dump exit port 96 to atmosphere.

Embodiment of FIGS. 4 and 5

The embodiment shown in FIGS. 4 and 5 is directed to a high pressure water gun shown at 10A having an outer gun body 11A with a cylindrical bore or opening 17A therethrough. A cylindrical valve body or body portion 16A is mounted in opening 17A of gun body 11A and secured therein by a retaining pin 19A extending through a slot 21A in valve body. Pin 19A has opposed ends mounted in gun body 11A to retain valve body portion 16A in a fixed position. An O-ring 21A mounted within groove 23A extends about valve body 16A for sealing between valve body 16A and main gun body 11A. High pressure water supply conduit 24A and opposed high pressure water discharge conduit 25A are threaded within valve body 16A. Valve body 16A has an outer annular groove forming a fluid passage 27A. A second O-ring 29A seals about valve body 16A.

Valve body 16A has a central bore receiving valve sleeve 30A and valve member 54A. A plug 44A secures valve sleeve 30A and valve member 54A within the central bore. Valve member 54A is shown in FIGS. 4 and 5 in a low pressure drain position with valve member 54A unseated from shoulder 57A. High pressure fluid from high pressure conduit 24A flows through ports 36A, bore 31A, ports 50A, and annular fluid passage 52A about plug 44A to annular fluid passage 27A. Low pressure fluid from passage 27A flows to atmosphere through dump passage 94A in enlarged guard portion 90A. The handle including the guard and handle grip in the embodiment of FIGS. 4 and 5 is integral with main gun body 11A. Trigger 78A is pivotally mounted at 80A to the handle grip and arm 82A is secured to trigger 78A. The operation of the embodiment of FIGS. 4 and 5 is similar to the embodiment of FIGS. 1–3.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A high pressure fluid blast apparatus for selectively initiating and relieving high pressure fluid flow from the discharge end of a high pressure fluid supply conduit; said apparatus comprising:

a body connected to the high pressure fluid supply conduit and having a valve chamber therein to receive high pressure fluid from said fluid supply conduit;

a high pressure fluid discharge conduit connected to said body in fluid communication with said valve chamber to receive high pressure fluid from said supply conduit for discharge;

a dump passage from said valve chamber to atmosphere;

a valve member mounted within said chamber for movement between one position blocking fluid flow from said supply conduit to said fluid dump passage and a second position permitting fluid flow from said supply conduit to said dump passage; and a handle including a handle grip portion and guard extending from said body and enclosing a trigger, said dump passage extending from said valve chamber through a portion of said guard to receive fluid from said valve chamber when said valve member is in said second position permitting a low pressure fluid flow from said supply conduit to said dump passage for flow to atmosphere.

2. A high pressure fluid blast apparatus as set forth in claim 1 wherein:

said body has a planar mounting face; and said handle has a planar mounting face secured to and in mating contact with said planar mounting face on said body.

3. A high pressure fluid blast apparatus as set forth in claim 2 wherein:

said handle has a mounting plate defining said planar mounting face thereon and supporting said guard and trigger; and fasteners removably secure said mounting plate to said body; said dump passage including an end port in said guard for flow of fluid to atmosphere from said dump passage.

4. A high pressure fluid blast apparatus as set forth in claim 1 wherein:

said body has a cylindrical opening therein, and a cylindrical valve body portion is mounted within said cylindrical opening.

5. A high pressure fluid blast apparatus as set forth in claim 1 wherein said supply conduit and said discharge conduit are parallel to each other.

6. A high pressure fluid blast apparatus as set forth in claim 1 wherein a sleeve is mounted within said valve chamber and said valve member is mounted within said sleeve for relative movement between said first and second positions.

7. A high pressure fluid blast apparatus for selectively initiating and relieving high pressure fluid flow from the discharge end of a high pressure fluid supply conduit; said apparatus comprising:

a valve body connected to the high pressure fluid supply conduit and having a central bore defining a valve chamber therein to receive high pressure fluid from said fluid supply conduit; said central bore having opposed upper and lower open ends;

a high pressure fluid discharge conduit connected to said valve body in fluid communication with said valve chamber to receive high pressure fluid from said supply conduit for discharge;

a dump passage from said valve chamber to atmosphere positioned below said fluid discharge conduit;

a cartridge mounted within said valve chamber including an outer fixed sleeve and a valve member mounted within said sleeve for movement between one position blocking fluid flow from said supply conduit to said dump passage and a second position permitting fluid flow from said supply conduit to said dump passage;

an end plug mounted in said upper open end of said central bore to retain said cartridge in position within said valve chamber; said plug having a blind central bore and a plurality of lateral ports extending from said central bore through the wall of said plug and in fluid communication with said supply conduit when said valve member is in said second position; said bore having an enlarged diameter bore portion about said plug to define an annular fluid chamber about said plug in communication with said lateral ports, said cartridge being removable from said valve chamber upon removal of said end plug from said upper open end of said bore; and said dump passage being in fluid communication with said lateral ports and said annular fluid chamber about said plug when said valve member is in said second position to permit fluid flow from said supply conduit to said dump passage.

8. A high pressure fluid blast apparatus as set forth in claim 7 wherein said valve body includes an outer body portion having a generally cylindrical opening therein; and a cylindrical body portion is received within said outer body portion and has said central bore therein receiving said cartridge.

9. A high pressure fluid blast apparatus as set forth in claim 7 wherein a handle including a handle portion and guard extend from said valve body.

10. A high pressure fluid blast apparatus as set forth in claim 9 wherein said dump passage extends from said annular fluid chamber through a portion of said guard to receive fluid from said annular fluid chamber when said valve member is in said second position to permit a low pressure fluid flow from said supply conduit to said dump passage.

11. A high pressure fluid blast apparatus as set forth in claim 10 wherein said dump passage includes a pair of generally parallel branch dump passages in said body in fluid communication with said annular fluid chamber about said plug.

12. A high pressure fluid blast apparatus for selectively initiating and relieving high pressure fluid flow from the discharge end of a high pressure fluid supply conduit; said high pressure fluid apparatus comprising:

a valve assembly including a body having a valve mounting face;

a handle assembly having a handle mounting face in opposed relation to said valve mounting face;

fasteners securing said mounting faces in mating face to face contact with each other;

said body having a central bore defining a valve chamber and opposed inlet and outlet ports communicating with said valve chamber, said high pressure fluid supply conduit being connected to said inlet port;

a high pressure fluid discharge conduit connected to said outlet port for receiving high pressure fluid from said high pressure fluid supply conduit for discharge;

a dump passage from said valve chamber to atmosphere; and a valve member mounted within said chamber for movement between one position blocking fluid flow from said supply conduit to said fluid dump passage and a second position permitting fluid flow from said supply conduit to said dump passage;

said handle assembly including a trigger and a guard about said trigger for enclosing said trigger, said dump passage extending through said mounting faces and an adjacent portion of said guard to receive fluid from said valve chamber when said valve member is in said second position permitting a low pressure fluid flow from said supply conduit to said dump passage for flow to atmosphere.

13. A high pressure fluid blast apparatus as set forth in claim 12 wherein:

said dump passage includes a dump port in said mounting face of said valve body and a pair of generally parallel branch dump passages in said body communicating with said dump port.

14. A high pressure fluid apparatus as set forth in claim 13 wherein said dump port is of a generally hemispherical shape.

15. A high pressure fluid blast apparatus for selectively initiating and relieving high pressure fluid flow from the discharge end of a high pressure fluid supply conduit; said high pressure fluid apparatus comprising:

an outer body having a cylindrical opening therein;

an inner cylindrical valve body received within said cylindrical opening and having an annular fluid passage extending about said valve body;

a high pressure fluid discharge conduit connected to one end of said cylindrical valve body and said high pressure fluid supply conduit connected to the other end of said cylindrical valve body;

a central bore extending transversely through said valve body to define a valve chamber in continuous communication with said conduits;

a dump passage in fluid communication with said annular fluid passage for communicating said valve chamber to atmosphere;

a valve member mounted within said valve chamber for movement between one position blocking fluid flow from said supply conduit to said dump passage and a second position permitting fluid flow from said supply conduit to said annular fluid passage about said valve body and thence to said dump passage;

a handle assembly including a trigger and a guard extending from a mounting plate about said trigger for enclosing said trigger, said dump passage receiving high pressure fluid from said high pressure supply conduit and said annular fluid passage when said valve member is in said second position permitting a low pressure fluid flow from said supply conduit to said dump passage for flow to atmosphere.

16. A high pressure fluid blast apparatus for selectively initiating and relieving high pressure fluid flow from the discharge end of a high pressure fluid supply conduit; said high pressure fluid apparatus comprising:

an outer body having a cylindrical opening therein;

an inner cylindrical valve body received within said cylindrical opening and having an annular fluid passage extending about said valve body;

a high pressure fluid discharge conduit connected to one end of said cylindrical valve body and said high pressure fluid supply conduit connected to the other end of said cylindrical valve body;

a central bore extending transversely through said valve body to define a valve chamber in continuous communication with said conduits;

a dump passage from said valve chamber to atmosphere;

a valve member mounted within said valve chamber for movement between one position blocking fluid flow from said supply conduit to said dump passage and a second position permitting fluid flow from said supply conduit to said dump passage;

a handle assembly including a trigger and a guard extending from a mounting plate about said trigger for enclosing said trigger, said dump passage extending through a portion of said guard to atmosphere and receiving high pressure fluid from said high pressure supply conduit when said valve member is in said second position permitting a low pressure fluid flow from said supply conduit to said dump passage for flow to atmosphere.

* * * * *